US008173856B2

(12) United States Patent
Tertel

(10) Patent No.: US 8,173,856 B2
(45) Date of Patent: May 8, 2012

(54) PROCESS FOR REDUCING CORROSION

(75) Inventor: Jonathan Andrew Tertel, Mt. Prospect, IL (US)

(73) Assignee: UOP LLC, Des Plaines, IL (US)

( * ) Notice: Subject to any disclaimer, the term of this patent is extended or adjusted under 35 U.S.C. 154(b) by 161 days.

(21) Appl. No.: 12/826,945

(22) Filed: Jun. 30, 2010

(65) Prior Publication Data

US 2012/0000826 A1 Jan. 5, 2012

(51) Int. Cl.
*C10G 31/00* (2006.01)

(52) U.S. Cl. ..... 585/854; 208/226; 208/230; 208/231; 208/234; 208/235

(58) Field of Classification Search ..... 208/226–228, 208/230–231, 234–235; 261/75–76, 78.1, 261/115–118; 210/188, 322, 513, 519; 585/854; 95/135, 137, 235
See application file for complete search history.

(56) References Cited

U.S. PATENT DOCUMENTS

| | | | | |
|---|---|---|---|---|
| 4,562,300 | A | 12/1985 | LaFoy | |
| 4,705,620 | A | 11/1987 | Bricker et al. | |
| 4,828,707 | A * | 5/1989 | Staehle et al. | 210/649 |
| 5,039,398 | A | 8/1991 | Stine et al. | |
| 5,237,823 | A | 8/1993 | Cheung et al. | |
| 5,470,441 | A | 11/1995 | Brown | |
| 6,565,740 | B2 | 5/2003 | Sain et al. | |
| 6,749,741 | B1 | 6/2004 | Laricchia et al. | |
| 6,960,291 | B2 | 11/2005 | Greaney et al. | |
| 7,014,751 | B2 | 3/2006 | Greaney et al. | |
| 7,326,333 | B2 | 2/2008 | Laricchia et al. | |
| 7,381,309 | B1 | 6/2008 | Laricchia et al. | |
| 2003/0136263 | A1 | 7/2003 | Beuke et al. | |
| 2010/0122936 | A1 | 5/2010 | Tertel et al. | |

FOREIGN PATENT DOCUMENTS

| | | |
|---|---|---|
| EP | 0 271 823 Al | 6/1988 |
| GB | 1 240 727 | 7/1971 |
| WO | 2005121279 A1 | 12/2005 |

OTHER PUBLICATIONS

Abstract of Akhmadullina et al., "Heterogeneous-Catalytic Demercaptanization of a Light Petroleum Feedstock", "East View Publications", 1993, No. 3, pp. 6-7.

(Continued)

*Primary Examiner* — Robert J Hill, Jr.
*Assistant Examiner* — Brian McCaig
(74) *Attorney, Agent, or Firm* — James C Paschall

(57) ABSTRACT

One exemplary embodiment can be a process for reducing corrosion during removal of one or more sulfur-containing hydrocarbons from a gas. Generally, the process includes producing an effluent including a caustic, one or more hydrocarbons, one or more sulfur compounds, and a gas from an oxidation vessel; sending the effluent to a stack of a disulfide separator; passing the gas, including oxygen and one or more sulfur compounds, through the stack; and passing a stream including one or more hydrocarbons to the stack at a temperature of less than about 38° C. for absorbing the one or more sulfur compounds. Typically, the stack includes one or more walls surrounding a void and adapted to receive a fluid including one or more phases, a packed bed positioned within the void, and a distributor including one or more risers and one or more compartments coupled to a substantially horizontal member forming a plurality of apertures there-through.

20 Claims, 1 Drawing Sheet

OTHER PUBLICATIONS

Ali et al., "Desulphurisation of a Gasoline Fraction from Partially Cracked Naphtha", "Fuel Science and Technology International", 1988, vol. 6, No. 4, pp. 397-414.

Basu et al., "Merox and Related Metal Phthalocyanine Catalyzed Oxidation Processes", "Catalysis Reviews—Science & Engineering", Dec. 1993, vol. 35, No. 4, pp. 571-609.

Mazgarov et al., "Removing Mercaptans and Hydrogen Sulfide from Oil Products", "Chemical and Petroleum Engineering ", Nov. 2003, vol. 39, No. 11-12, pp. 719-721.

Mazgarov et al., "Combined Scheme for Demercaptization of Light Fractions from Crude Oils and Gas Condensates of the Caspian Depression", "Chemistry and Technology of Fuels and Oils", Nov. 1987, vol. 23, No. 11, pp. 524-527.

Abstract of Zhou et al., "Discussion on the Improvement of LPG Sweetening Process for Energy Saving and Pollution Reduction", "Petroleum Processing and Petrochemicals", 2008, vol. 39(3), pp. 51-57.

* cited by examiner

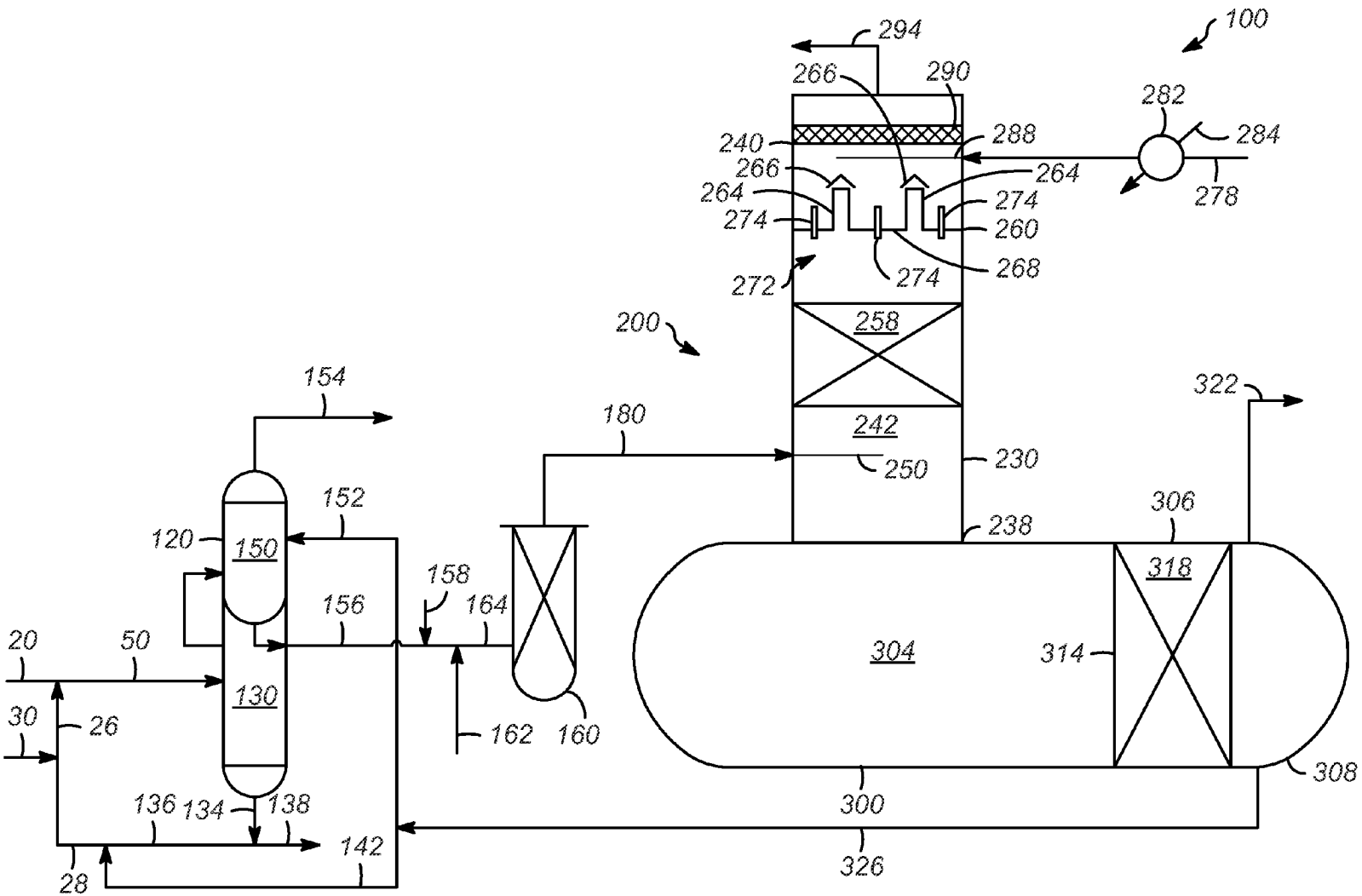
100
284
278
282
288
264
274
260
268
290
294
266
240
266
264
274
272
258
242
250
230
238
274
200
180
322
306
318
314
308
304
300
326
160
162
164
158
154
152
156
150
130
120
138
142
134
136
50
26
20
30
28

PROCESS FOR REDUCING CORROSION

FIELD OF THE INVENTION

This invention generally relates to a process for reducing corrosion, particularly a process for reducing corrosion during removal of one or more sulfur-containing hydrocarbons from a gas.

DESCRIPTION OF THE RELATED ART

Often, hydrocarbon and gas streams are treated to remove sulfur-containing compounds, such as mercaptans. Generally, such compounds are removed because of their malodorous scent.

Mercaptans can be designated R—S—H where R is often a light hydrocarbon radical such as methyl or ethyl. Typically, mercaptans concentrate in hydrocarbon liquid streams separated in a process facility. Many processes can be used to remove mercaptans and other sulfur-containing compounds. Often, such processes can use a caustic stream contacting the hydrocarbon stream in an extractive system.

After use, the caustic stream may be regenerated. As such, air may be used for oxidizing mercaptans to disulfide oils. The unreacted components of the air stream, e.g. nitrogen, oxygen, and other inert gases, are separated from the caustic and disulfide oils. Often, a separation vessel allows the unreacted air components to exit in a vent gas stream.

Generally, the vent gas stream contains primarily air and small amounts of water, hydrocarbons, and disulfide oils. Typically, this air stream can contain up to about one mole percent disulfide. However, the presence of disulfide oils can create regulatory concerns. Due to these concerns, it is often desired to treat the vent gas to remove the disulfide oils.

Often, corrosion of equipment surrounding the vent gas stream is a problem. Hence, it is desirable to minimize corrosion during removal of such sulfur-containing hydrocarbons.

SUMMARY OF THE INVENTION

One exemplary embodiment can be a process for reducing corrosion during removal of one or more sulfur-containing hydrocarbons from a gas. Generally, the process includes producing an effluent including a caustic, one or more hydrocarbons, one or more sulfur compounds, and a gas from an oxidation vessel; sending the effluent to a stack of a disulfide separator; passing the gas, including oxygen and one or more sulfur compounds, through the stack; and passing a stream including one or more hydrocarbons to the stack at a temperature of less than about 38° C. for absorbing the one or more sulfur compounds. Typically, the stack includes one or more walls surrounding a void and adapted to receive a fluid including one or more phases, a packed bed positioned within the void, and a distributor including one or more risers and one or more compartments coupled to a substantially horizontal member forming a plurality of apertures there-through.

Another exemplary embodiment may be a process for reducing corrosion during removal of one or more sulfur-containing hydrocarbons from a gas. Generally, the process includes producing an effluent including a caustic, one or more hydrocarbons, one or more sulfur compounds, and a gas from an oxidation vessel; sending the effluent to a stack of a disulfide separator; passing the gas, including oxygen and one or more sulfur compounds, through the stack; and passing a stream including one or more hydrocarbons having a boiling point of about 50-about 300° C. and no more than about 10 ppm, by weight, sulfur based on the weight of the hydrocarbon stream to the stack at a temperature of less than about 38° C. for absorbing the one or more sulfur compounds. Typically, the stack includes one or more walls surrounding a void and adapted to receive a fluid including one or more phases, a packed bed positioned within the void, and a distributor including one or more risers and one or more compartments coupled to a substantially horizontal member forming a plurality of apertures there-through.

A further exemplary embodiment can be a process for reducing corrosion during removal of one or more sulfur-containing hydrocarbons from a gas. Usually, the process includes cooling a hydrocarbon stream having a boiling point of about 50-about 300° C. and no more than about 10 ppm, by weight, sulfur based on the weight of the hydrocarbon stream to a temperature of less than about 38° C., and providing the hydrocarbon stream to a stack of a disulfide separator.

As disclosed herein, the embodiments can provide the removal of one or more sulfur-containing hydrocarbons from a gas. Typically, a stream having one or more hydrocarbons is provided at a temperature effective to minimize corrosion, such as a temperature of less than about 38° C.

DEFINITIONS

As used herein, hydrocarbon molecules may be abbreviated C1, C2, C3 . . . Cn where "n" represents the number of carbon atoms in the one or more hydrocarbon molecules.

As used herein, the term "rich" can mean an amount of generally at least about 50%, and preferably about 70%, by mole, of a compound or class of compounds in a stream.

As used herein, the term "substantially" can mean an amount of generally at least about 80%, preferably about 90%, and optimally about 99%, by mole, of a compound or class of compounds in a stream.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, an absorber, or a vessel, can further include one or more zones or sub-zones.

As used herein, the term "coupled" can mean two items, directly or indirectly, joined, fastened, associated, connected, or formed integrally together either by chemical or mechanical means, by processes including stamping, molding, or welding. What is more, two items can be coupled by the use of a third component such as a mechanical fastener, e.g., a screw, a nail, a bolt, a staple, or a rivet; an adhesive; or a solder.

As described herein, the term "coalescer" is a device containing glass fibers or other material to facilitate separation of immiscible liquids of similar density.

As used herein, the term "immiscible" means two or more phases that cannot be uniformly mixed or blended.

As used herein, the term "phase" means a liquid, a gas, or a suspension including a liquid and/or a gas, such as a foam, aerosol, or fog. A phase may include solid particles. Generally, a fluid can include one or more gas, liquid, and/or suspension phases.

BRIEF DESCRIPTION OF THE DRAWING

FIG. 1 is a schematic depiction of an exemplary apparatus.

DETAILED DESCRIPTION

Referring to FIG. 1, an exemplary apparatus 100 for removing one or more sulfur-containing compounds, such as mercaptans, from a hydrocarbon stream 20 is depicted in FIG. 1. Typically, the apparatus 100 can include an extractor vessel 120, an oxidation vessel 160, and a separation vessel 200. The vessels, lines and other equipment of the apparatus 100 can be made from any suitable material, such as carbon steel, stainless steel, or titanium. As depicted, process flow lines in the figures can be referred to, interchangeably, as lines, pipes, branches, distributors, streams, effluents, feeds, products, catalysts, withdrawals, recycles, and caustics. An exemplary extractor vessel, oxidation vessel, and separation vessel are disclosed in US 2010/0122936 A1.

The hydrocarbon stream 20 is typically in a liquid phase and can include a fuel gas stream, a liquefied petroleum gas, or a naphtha hydrocarbon. Typically, the hydrocarbon stream 20 contains sulfur compounds in the form of one or more mercaptans and/or hydrogen sulfide. Generally, the apparatus 100 can also include a caustic prewash vessel. Exemplary apparatuses having at least a caustic prewash vessel, an extractor vessel, an oxidation vessel, and a separation vessel for removing sulfur-containing compounds from a hydrocarbon stream are disclosed in, e.g., U.S. Pat. No. 7,326,333 B2.

A hydrocarbon stream 20 can be an effluent from, for example, an amine absorber. The hydrocarbon stream 20 can include hydrogen sulfide and C2-C8 hydrocarbons. Usually, the hydrocarbon stream 20 can include up to about 100 ppm, by weight, hydrogen sulfide. Generally, the hydrocarbon stream 20 is combined with a stream 26 including water from a stream 30 and a combined caustic stream 28, as hereinafter described, for removing, e.g., hydrogen sulfide. The caustic can be any alkaline material, and generally includes caustic soda (NaOH) and caustic alcohol ($C_2H_3ONa$). The streams 20 and 26 are combined as an extractor feed 50. The extractor feed 50 can enter the extractor vessel 120. The extractor vessel 120 can include a lower pre-wash section 130, and an upper extractor section 150. The extractor feed 50 can enter the lower prewash section 130. A predominately hydrocarbon phase can rise while the caustic can fall in the lower prewash section 130. The caustic can be withdrawn via a caustic withdrawal 134 with a portion being spent caustic 138 and another portion being a caustic recycle 136. A transfer conduit can communicate the hydrocarbon phase with the upper extractor section 150.

The hydrocarbon product 154 mostly free of mercaptans and mercaptides can be withdrawn from the top of the upper extractor section 150 while a spent caustic including mercaptides can be withdrawn via a line 156. The spent caustic 156 can be combined with an oxidation catalyst 158 and an air stream 162. The oxidation catalyst 158 can be any suitable oxidation catalyst, such as a sulfonated metal phthalocyanine. However, any suitable oxidation catalyst can be used such as those described in, e.g., U.S. Pat. No. 7,326,333 B2. The oxidation catalyst 158, the air stream 162, and the spent caustic 156 can be combined in a line 164 before entering the oxidation vessel 160. The spent aqueous caustic and air mixture is distributed in the oxidation vessel 160. In the oxidation vessel 160, the sodium mercaptides catalytically react with oxygen and water to yield caustic and organic disulfides. Optionally, the oxidation vessel 160 can include packing, such as carbon rings, to increase the surface area for improving contact between the spent caustic and catalyst. Afterwards, an effluent 180 from the oxidation vessel 160 can be withdrawn from the top of the oxidation vessel 160. The effluent 180 can include caustic, one or more hydrocarbons, one or more sulfur compounds, and a gas, and may have three phases. Typically, the effluent 180 can include a gas phase, a liquid disulfide phase, and a liquid aqueous caustic phase. Generally, the gas phase includes air with at least some oxygen depletion. In the gas phase, the oxygen content can be about 5-about 21%, by mole.

The effluent 180 can be received in the separation vessel 200. The separation vessel 200 can be any suitable process equipment, such as a disulfide separator. The separation vessel 200 can include a stack 230 and a base 300. The separation vessel 200 can be operated at any suitable conditions, such as no more than about 60° C. and about 250-about 500 kPa, preferably about 350-about 450 kPa.

The stack 230 can be any suitable dimension for receiving the three-phase effluent 180. Generally, the stack 230 is substantially cylindrical in shape having one or more walls 240 forming a void 242.

In addition, the base 300 can have any suitable dimensions. Typically, the base 300 has a length and a height creating an interior space 304. Generally, the base 300 has a top 306 and a bottom 308. Generally, the stack 230 is coupled to the base 300 at any suitable angle. Preferably, the stack 230 is connected at an end 238 at a substantially perpendicular orientation with respect to the length of the base 300.

The stack 230 can contain a first distributor 250, a packed bed 258, a second distributor 260, a third distributor 288, and a demister 290. Generally, the first distributor 250 and the third distributor 288 can be any suitable distributor, such as respectively, a pipe with the same or different sized slots for distributing the effluent 180 in the stack 230. The second distributor 260 can be placed above the packed bed 258 and can be any suitable distributor, such as an elongated pipe with one or more slots, or a distributor as disclosed in, e.g., U.S. Pat. No. 5,237,823 or U.S. Pat. No. 5,470,441. Generally, the liquid phases fall downward toward the base 300 and the gas phase rises upward in the stack 230. Usually, the packed bed 258 can include packing elements that increase the surface area of the fluids interacting, as further described herein.

The packing elements can be any suitable packing. One exemplary packing is ring packing, such as RASCHIG packing material sold by Raschig GmbH LLC of Ludwigshafen, Germany. Other types of packing can include structured packing, fiber and/or film contactors, or tray systems, e.g. one or more trays, as long as suitable contact is attained. Typically, the ring packing can be any suitable dimension, but is typically about 1-about 5 cm in diameter. The packing elements can be made from any suitable material, including carbon steel, stainless steel, or carbon.

Referring to FIG. 1, the second distributor 260 can include one or more risers 264, one or more drip guards 266 positioned above the risers 264, a substantially horizontal member 268, and one or more compartments 274. Typically, the substantially horizontal member 268 forms a plurality of apertures 272, which can have any suitable shape and be the same or different sizes. The one or more risers 264 can be positioned around at least some of the apertures 272 to allow gases to rise upward through the substantially horizontal member 268. The one or more compartments 274 generally have one or more holes in the side of the compartments to allow built-up fluid on the substantially horizontal member 268 to pass there-through to the packed bed 258 below. Typically, a base of a compartment 274 can be coupled to the substantially horizontal member 268 with any suitable means, such as welding. In some exemplary embodiments, the periphery of one or more risers can at least partially define one or more compartments. Distributors 260 and 288 can also be combined to provide a single wash oil distributor.

The third distributor 288 can be any suitable distributor providing a hydrocarbon stream 278 having a boiling point of about 50-about 300° C. Typically, the hydrocarbon stream 278 can be a wash oil that includes hydrotreated heavy naphtha, kerosene, or diesel oil with little or no sulfur. Generally, it is preferable that the hydrocarbon stream 278 has less than about 10 ppm, preferably less than about 1 ppm, by weight, of sulfur.

Usually, a wash oil, such as a hydrotreated heavy naphtha or kerosene, is provided to the stack 230. Often, the temperature of the hydrocarbon stream 278 prior to being cooled may be about 38-about 60° C., which may not be effective to minimize corrosion. The hydrocarbon stream 278 can be passed through an exchanger or a water cooler 282. Typically, the cooling water exchanger 282 can receive a cooling water stream 284 to lower the temperature of the hydrocarbon stream 278 effective to minimize corrosion. The temperature of the hydrocarbon stream 278 exiting the exchanger 282 can be less than about 38° C., no more than about 36° C., and no more than about 32° C. Alternatively, the temperature of the hydrocarbon stream 278 can be about 25-less than about 38° C., preferably about 25-no more than about 32° C.

The demister 290 can be any suitable demister for removing liquid particles from a rising gas. Generally, the demister 290 can be a mesh or vane demister, preferably a mesh demister. During washing of the gas phase in the separation vessel 200, the third distributor 288 can provide the hydrocarbon stream 278 to the stack 230. The cooled hydrocarbon stream 278, typically a wash oil, can reduce or prevent corrosion in equipment and piping in gas service, e.g., the stack 230 and a line 294. The wash oil can then fall downward to the second distributor 260. The wash oil can collect on the substantially horizontal member 268 before passing through the one or more compartments 274 to the packed bed 258 below. The gas passing upward from the first distributor 250 can pass upward through the packed bed 258 with mass transfer occurring between the gas and the wash oil in the packed bed 258. The organic disulfide compounds can be stripped from the gas and collect in the wash oil which can drop from the stack 230 to the base 300 below. The cooled gas can rise upward and pass through the one or more risers 264. The one or more drip guards 266 can prevent the wash oil from entering the one or more risers 264. Subsequently, the gas then passes through the demister 290 where any entrained liquid is removed. Afterwards, the gas can pass upwards through the stack and exit via the line 294. Generally, the total sulfur in the air exiting the stack 230 can be no more than about 100 ppm, by weight. As such, the gas can be sent or optionally blended with fuel gas for use as a fuel in a heater or furnace.

The wash oil, liquid disulfide, and aqueous caustic phases can enter the base 300. The base 300 can include a coalescer 314. Generally, the coalescer 314 can include one or more coalescer elements 318, which can include at least one of a metal mesh, one or more glass fibers, sand, or an anthracite coal. The various liquid phases can pass through the coalescer 314 and be separated. Generally, the wash oil and the disulfide phase can exit via a line 322 to optionally enter a filter, such as a sand filter, to remove traces of caustic from an effluent.

Generally, the caustic can exit the bottom 308 of the base 300 through a line 326 and be split into separate branches 142 and 152. The regenerated caustic in the line 142 can be combined with caustic 136, and subsequently be combined with the hydrocarbon stream 20. Another branch 152 can be provided to the upper extractor section 150 of the extractor vessel 120, as described above.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for reducing corrosion during removal of one or more sulfur-containing hydrocarbons from a gas, comprising:
   - A) producing an effluent comprising a caustic, one or more hydrocarbons, one or more sulfur compounds, and a gas from an oxidation vessel;
   - B) sending the effluent to a stack of a disulfide separator, wherein the stack comprises:
     - 1) one or more walls surrounding a void and adapted to receive a fluid comprising one or more phases;
     - 2) a packed bed positioned within the void; and
     - 3) a distributor comprising one or more risers and one or more compartments coupled to a substantially horizontal member forming a plurality of apertures therethrough;
   - C) passing the gas through the stack wherein the gas comprises oxygen and one or more sulfur compounds; and
   - D) passing a stream comprising one or more hydrocarbons to the stack at a temperature of less than about 38° C. for absorbing the one or more sulfur compounds.

2. The process according to claim 1, wherein the temperature is no more than about 32° C.

3. The process according to claim 1, wherein the temperature is about 25-less than about 38° C.

4. The process according to claim 1, wherein the temperature is about 25-no more than about 32° C.

5. The process according to claim 1, wherein the disulfide separator is at a temperature of no more than about 60° C. and a pressure of about 250-about 500 kPa.

6. The process according to claim 1, wherein the gas further comprises nitrogen.

7. The process according to claim 1, wherein the packed bed comprises one or more packing elements, in turn, comprising at least one of a random or structured packing, a fiber contactor, a film contactor, and one or more trays.

8. The process according to claim 1, wherein the hydrocarbon stream comprises a hydrotreated heavy naphtha, a kerosene, or a diesel oil.

9. The process according to claim 1, further comprising passing the hydrocarbon stream through a cooling water exchanger or water cooler before entering the stack of the disulfide separator.

10. The process according to claim 1, wherein the hydrocarbon stream has no more than about 10 ppm, by weight, sulfur based on the weight of the hydrocarbon stream.

11. The process according to claim 1, wherein the hydrocarbon stream has no more than about 1 ppm, by weight, sulfur based on the weight of the hydrocarbon stream.

12. The process according to claim 1, wherein the hydrocarbon stream has a boiling point of about 50-about 300° C. and no more than about 10 ppm, by weight, sulfur based on the weight of the hydrocarbon stream.

13. The process according to claim 1, wherein the disulfide separator further comprises:

a base, wherein the base defines an interior space; and a coalescer positioned within the interior space.

14. The process according to claim 1, further comprising positioning a demister above the distributor in the stack.

15. The process according to claim 14, wherein the demister comprises a mesh demister or a vane demister.

16. The process according to claim 1, wherein the gas comprises about 8-about 12%, by volume, oxygen.

17. A process for reducing corrosion during removal of one or more sulfur-containing hydrocarbons from a gas, comprising:

A) producing an effluent comprising a caustic, one or more hydrocarbons, one or more sulfur compounds, and a gas from an oxidation vessel;

B) sending the effluent to a stack of a disulfide separator, wherein the stack comprises:

1) one or more walls surrounding a void and adapted to receive a fluid comprising one or more phases;

2) a packed bed positioned within the void; and 3) a distributor comprising one or more risers and one or more compartments coupled to a substantially horizontal member forming a plurality of apertures therethrough;

C) passing the gas through the stack wherein the gas comprises oxygen and one or more sulfur compounds; and D) passing a stream comprising one or more hydrocarbons having a boiling point of about 50-about 300° C. and no more than about 10 ppm, by weight, sulfur based on the weight of the hydrocarbon stream to the stack at a temperature of less than about 38° C. for absorbing the one or more sulfur compounds.

18. The process according to claim 17, wherein the hydrocarbon stream comprises a hydrotreated heavy naphtha, a kerosene, or a diesel oil.

19. A process for reducing corrosion during removal of one or more sulfur-containing hydrocarbons from a gas, comprising:

A) cooling a hydrocarbon stream having a boiling point of about 50-about 300° C. and no more than about 10 ppm, by weight, sulfur based on the weight of the hydrocarbon stream to a temperature of less than about 38° C.; and B) providing the hydrocarbon stream to a stack of a disulfide separator.

20. The process according to claim 19, wherein the hydrocarbon stream comprises a hydrotreated heavy naphtha, a kerosene, or a diesel oil.

* * * * *